US005437569A

United States Patent [19]

Ming

[11] Patent Number: 5,437,569

[45] Date of Patent: Aug. 1, 1995

[54] MULTIPURPOSE FLOATABLE BLANKET

[75] Inventor: Cheng C. Ming, Taipei, Taiwan

[73] Assignee: Eurogear Corporation, Taipei Hsien, Taiwan

[21] Appl. No.: 302,972

[22] Filed: Sep. 12, 1994

[51] Int. Cl.[6] ..... B63C 9/08

[52] U.S. Cl. ..... 441/129; 5/417; 5/449; 5/502; 441/113; 441/125

[58] Field of Search ..... 441/88, 106, 108, 113, 441/125, 128, 129; 5/417, 420, 448, 449, 461, 482, 502

[56] References Cited

U.S. PATENT DOCUMENTS

| | | | |
|---|---|---|---|
| 2,853,399 | 9/1958 | Shoults | 5/417 X |
| 3,421,163 | 1/1969 | Stoughton | 5/449 |
| 3,636,577 | 1/1972 | Nissen | 5/420 |
| 3,733,631 | 5/1973 | Cohn | 441/113 |
| 5,048,975 | 9/1991 | Holbrook | 5/420 X |
| 5,226,184 | 7/1993 | Cheng | 441/125 |

*Primary Examiner*—Sherman Basinger
*Attorney, Agent, or Firm*—Bacon & Thomas

[57] ABSTRACT

A floatable blanket formed of a water-proof outer layer and a plurality of intermediate layers inside the water-proof outer layer, the intermediate layers being made of foamed polyethylene and separated into two groups with an air chamber defined between, air vents being made through the bottom of the water-proof outer layer for allowing air to be induced into the air chamber, loops being aligned on the outside of the water-proof outer layer for allowing the blanket to be arranged into a ring for use as a life buoy.

2 Claims, 5 Drawing Sheets

MULTIPURPOSE FLOATABLE BLANKET

BACKGROUND OF THE INVENTION

The present invention relates to a floatable blanket which can be used as a picnic napkin or an inflatable beach mattress, and which can be arranged into the shape of a ring for use as a life buoy.

Inflatable beach mattresses and life buoys are commonly used for playing water games. These devices must be inflated before use, and they become inconvenient to carry when inflated. Further, these devices can not be used for other purposes.

SUMMARY OF THE INVENTION

The present invention has been accomplished under the aforesaid circumstances. The principal object of the present invention is to provide a floatable blanket which uses foamed polyethylene to provide sufficient buoyancy without the process of inflating. Another object of the present invention is to provide a floatable blanket which has vents for inducing air into an internal air chamber thereof to increase its buoyancy. Still another object of the present invention is to provide a floatable blanket which has loops on the outside so that it can be folded up and then fastened into the shape of a ring by a belt for use as a life buoy. Still another object of the present invention is to provide a floatable blanket which has twisted handles and zip fasteners so that it can be folded up and then fastened into a bag for carrying things. Still another object of the present invention is to provide a floatable blanket which is flexible, and can be conveniently folded up to minimize its space occupation. Still another object of the present invention is to provide a floatable blanket which is easy to manufacture.

BRIEF DESCRIPTION OF THE DRAWINGS

FIG. 3A is an applied view of the present invention showing the blanket put in water to float the person lying on;

DETAILED DESCRIPTION OF THE PREFERRED EMBODIMENTS

Figure 1A:
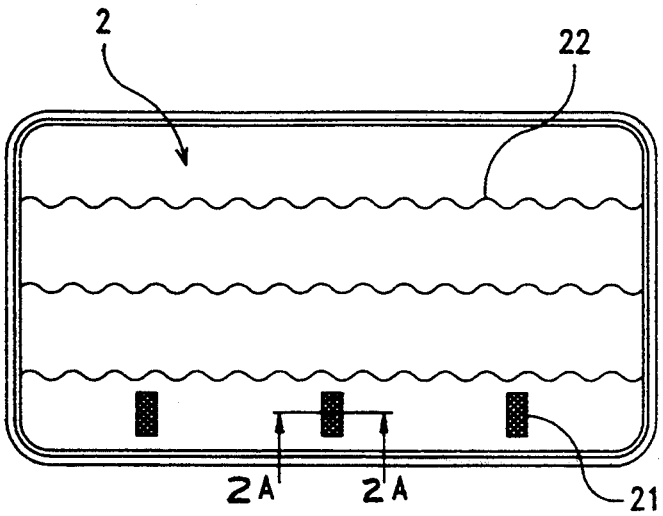
FIG. 1A is the top view of a multipurpose floatable blanket according to the preferred embodiment of the present invention.
Figure 1B:
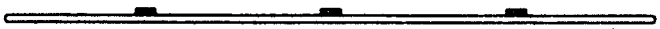
FIG. 1B is the side view of a multipurpose floatable blanket according to the preferred embodiment of the present invention.
Figure 1C:
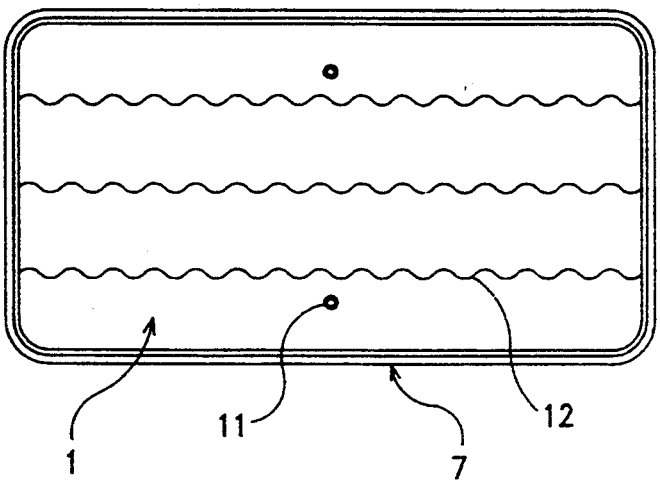
FIG. 1C is the bottom view of a multipurpose floatable blanket according to the preferred embodiment of the present invention.

Referring to FIGS. 1A, 1B, 1C and 2A, a floatable blanket in accordance with the present invention is made in a substantially flat, rectangular configuration, comprised of a top layer 2, a bottom layer 1, and a plurality of intermediate layers 3;4;5;6 retained between the top and bottom layers. The top and bottom layers 2;1 are made of a water proof material. The intermediate layers 3;4;5;6 are made of foamed polyethylene consisted of a plurality of air cells. A plurality of vents 11 are made through the bottom layer 1 and the adjacent intermediate layer, namely, the lowest intermediate layer 3. The lowest intermediate layer 3 and the bottom layer 1 are fastened together by longitudinal seam lines 12 through a zigzag stitching method. A series of loops 21 are made on the top layer 2 with respect center holes aligned in the longitudinal direction. The lowest intermediate layer 3 and the bottom layer 1 are fastened together and formed into a lower structure, and the other intermediate layers 4;5;6 and the top layer 2 are fastened together by longitudinal seam lines 22 through a zigzag stitching method and formed into an upper structure, therefore a space is defined the upper and lower structures. However, all layers 1;2;3;4;5;6 are peripherally sealed by an endless edge 7.

According to Archimedes' principle, a body immersed in a fluid is buoyed up by a force equal to the weight of the fluid displaced by the body. Assume the weight of the body is 100 kgs, thus:

Force
= body density × body volume − water density × body volume
= 1.07 × body volume − 1.00 × body volume
= (1.07 − 1.00) × body volume
= 0.07 × (body weight/body density)
= 0.07 × (100/1.07)
= 6.542

Figure 2A:
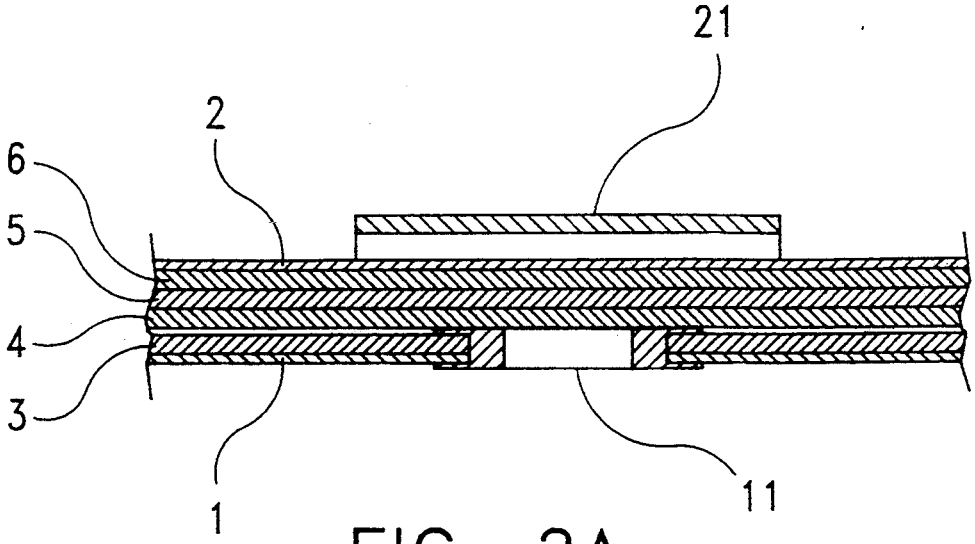
FIG. 2A is a sectional view taken on line A—A of FIG. 1A.

Therefore, the buoyancy of 6.542 kgs is sufficient to buoy up a person of 100 kgs, and it is obtained in the same manner that:

100 kgs body weight needs 6.542 kgs buoyancy
80 kgs body weight needs 5.233 kgs buoyancy
60 kgs body weight needs 3.925 kgs buoyancy
40 kgs body weight needs 2.617 kgs buoyancy A sample of the structure of floatable blanket shown in FIG. 2A was tested by Japan Ship Quality Control Association and proved having buoyancy of 13.7 kgs sufficient to buoy up a person of more than 100 kgs.

Figure 2B:
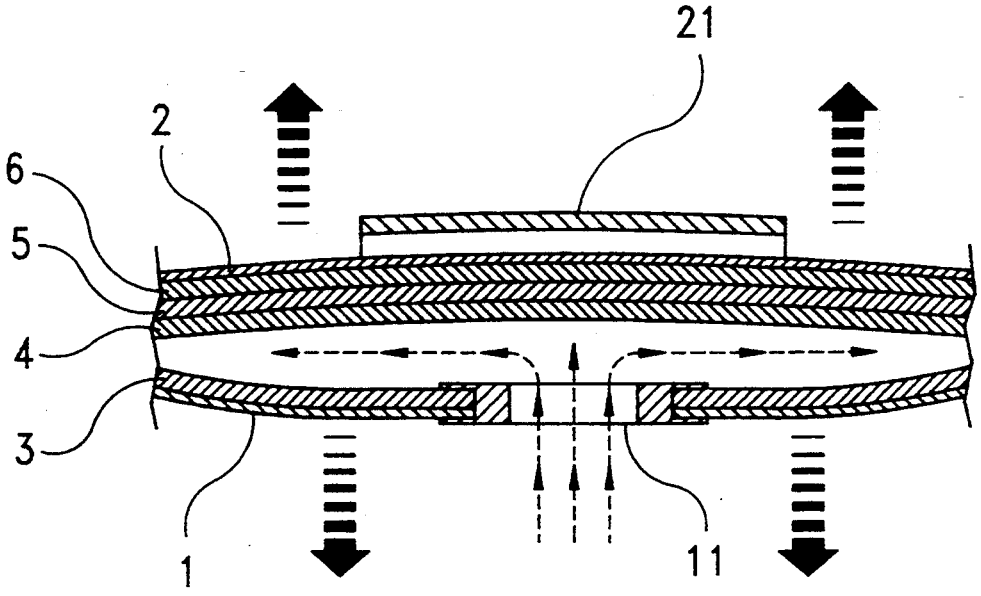
FIG. 2B is similar to FIG. 2B but showing inflated.

Referring to FIG. 2B and FIGS. 1A, 1B, 1C, again as the upper structure is pulled upwards from the lower structure to increase the space of the space defined therebetween, outside air is induced through the vents 11 into the space between the upper and lower structures to increase the buoyancy of the floatable blanket. As the floatable blanket is put on the water, the vents 11 are automatically sealed by the water surface, and therefore the floatable blanket is kept in an inflated condition. Further, the zigzag stitching of seam lines 12, 32 facilitate the accumulation of air in the floatable blanket.

Figure 3A:
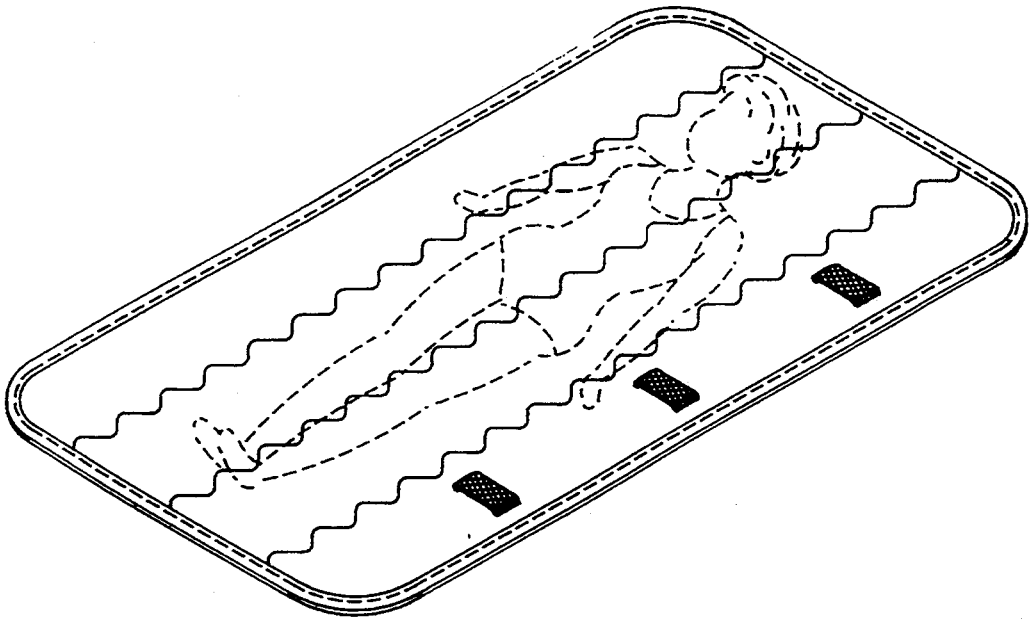

Referring to FIG. 3A, the floatable blanket may be extended out and put on the water to buoy up a person. It can also be used as a picnic napkin.

Figure 3B:
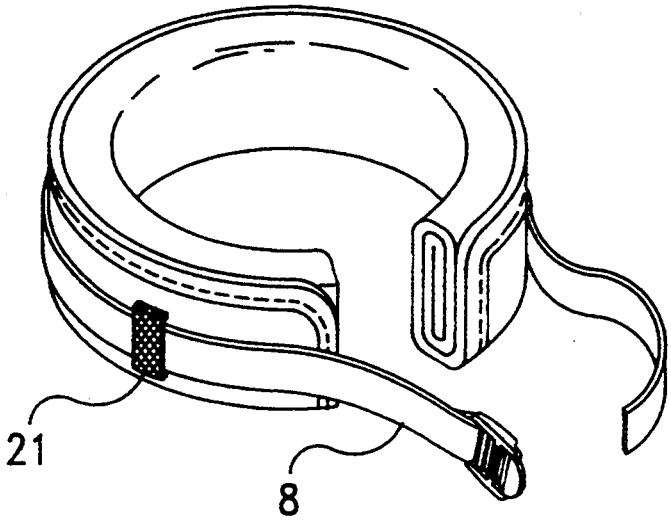
FIG. 3B shows the blanket arranged into the shape of a ring for use as a life buoy.
Figure 5:
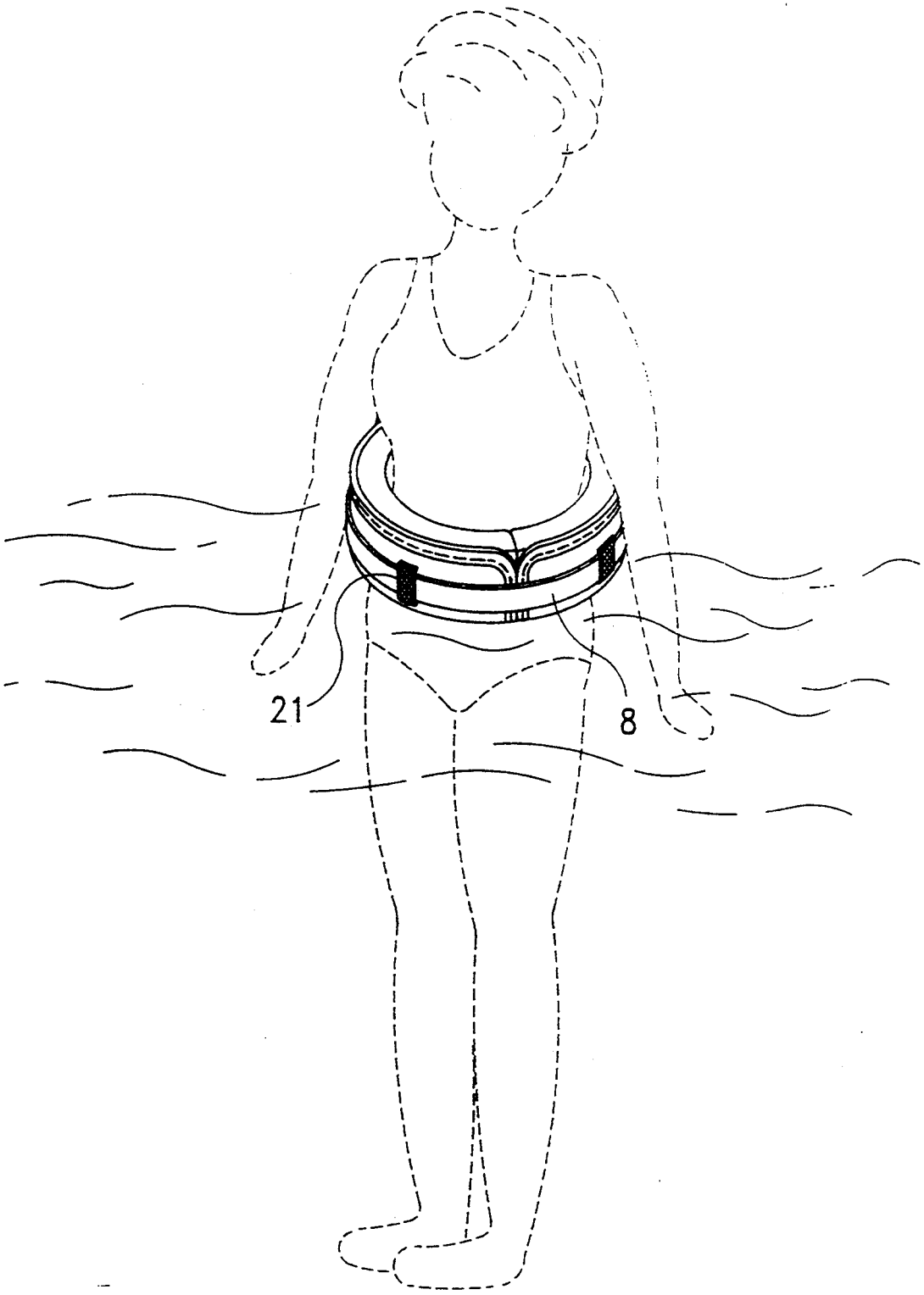
FIG. 5 illustrates the floatable blanket arranged into the shape of a ring and used as a life buoy to buoy up the user.

Referring to FIGS. 3B and 5, the floatable blanket may be folded up and arranged into the shape of a ring with the loops 21 disposed on the outside, and then a belt 8 is inserted through the loops 21 to fasten the folded up floatable blanket, and therefore the folded up floatable blanket is used as a life buoy.

Figure 4A:
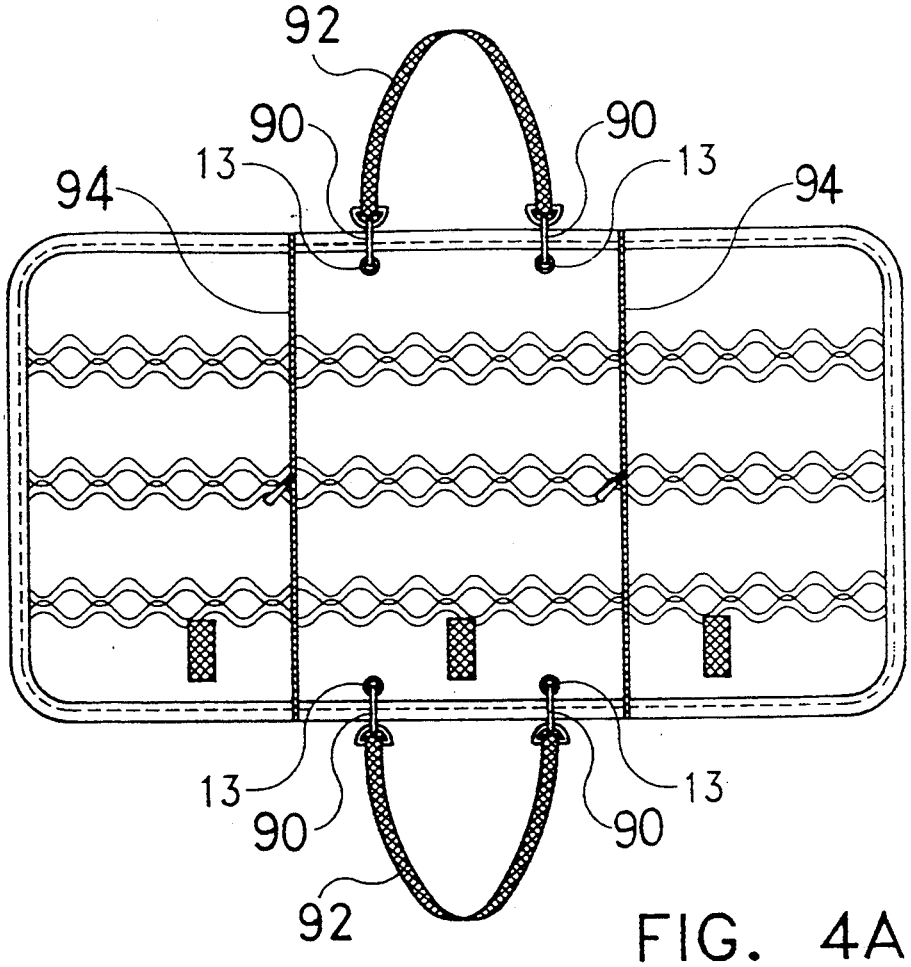
FIG. 4A is an extended out view of an alternate form of the floatable blanket of the present invention.
Figure 4B:
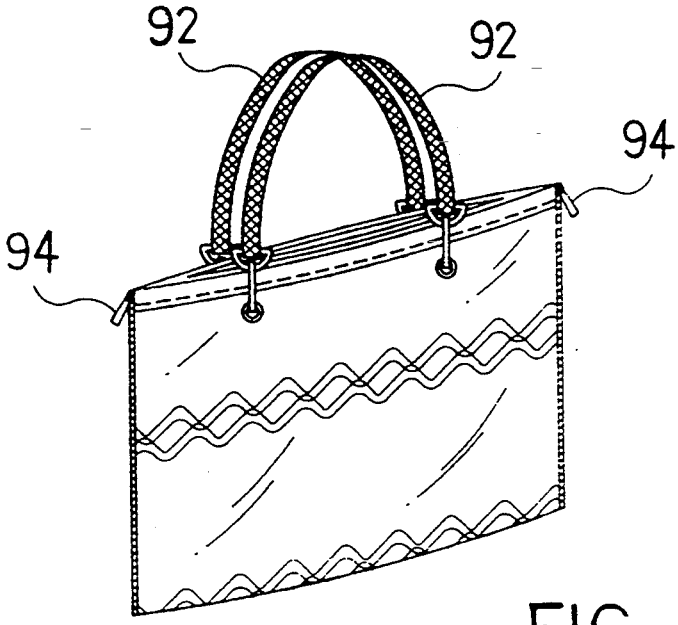
FIG. 4B shows the floatable blanket of FIG. 4A arranged into the shape of a bag.

Referring to FIGS. 4A and 4B, therein illustrated is an alternate form of the present invention. Two pairs of spaced holes 13 are made on the floatable blanket on two opposite long sides thereof and respectively fastened with a respective loop 90. Two twisted handles 92 are fastened to the loops 90 on either side. Two zip fasteners 94 are symmetrically made on the floatable blanket across the width. Therefore, the floatable blank can be folded up and fastened into the shape of a bag by the zip fasteners 94 for carrying things with the hand through the twisted handles 92.

While only few embodiments of the present invention have been show and described, it will be understood that various modifications and changes could be made without departing from the spirit and scope of the invention.

What is claimed is:

1. A floatable blanket made in a substantially flat, rectangular configuration, comprised of a top layer, a bottom layer, and a plurality of intermediate layers retained between said top and bottom layers, said top and bottom layers being made of a water proof material, said intermediate layers being made of foamed polyethylene consisted of a plurality of air cells, said top and bottom layers and said intermediate layers being peripherally sealed, said bottom layer and the adjacent intermediate layers being fastened together by longitudinal seam lines of zigzag stitches and formed into a lower structure, the other intermediate layers and said top layer being fastened together by longitudinal seam lines of zigzag stitches and formed into an upper structure, said upper and lower structure having a plurality of vents in communication with said air chamber, said top layer comprising a series of loops longitudinally aligned on the outside.

2. The floatable blanket of claim 1 which further comprises two twisted handles fastened to two spaced loops on two opposite long side thereof, and two zip fasteners disposed on two opposite sides relative to said twisted handles across the width.

* * * * *